US007552992B2

(12) United States Patent
Owaki

(10) Patent No.: US 7,552,992 B2
(45) Date of Patent: Jun. 30, 2009

(54) LIQUID JET HEAD UNIT AND LIQUID JET DEVICE

(75) Inventor: Hiroshige Owaki, Nagano-ken (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 11/955,264

(22) Filed: Dec. 12, 2007

(65) Prior Publication Data

US 2008/0100664 A1 May 1, 2008

Related U.S. Application Data

(63) Continuation of application No. 11/198,397, filed on Aug. 8, 2005, now Pat. No. 7,328,965.

(30) Foreign Application Priority Data

Aug. 11, 2004 (JP) ..... 2004-234762

(51) Int. Cl.
*B41J 2/015* (2006.01)

(52) U.S. Cl. ..... 347/20; 347/45; 347/71

(58) Field of Classification Search ..... 347/20, 347/22, 29, 33, 44, 45, 47, 49, 68, 70, 71, 347/84–87

See application file for complete search history.

(56) References Cited

U.S. PATENT DOCUMENTS 4,343,013 A 8/1982 Bader et al.
6,206,499 B1 3/2001 Iijima et al.
7,044,578 B2 5/2006 Owaki et al.
7,328,965 B2 * 2/2008 Owaki ..... 347/20

FOREIGN PATENT DOCUMENTS

JP 9-123461 A 5/1997
JP 10-34920 A 2/1998

* cited by examiner

*Primary Examiner*—Juanita D Stephens
(74) *Attorney, Agent, or Firm*—Sughrue Mion, PLLC

(57) ABSTRACT

Provided are a liquid jet head unit and a liquid jet device which are capable of improving precision in aligning nozzle orifices and accordingly printing quality. The liquid jet head includes: a liquid jet head having a nozzle plate provided with nozzle rows constituted of nozzle orifices through which liquid droplets are ejected, and which are arranged side by side; a head case fixed to the liquid jet head at the side of liquid supply ports; and a cover head provided to a liquid-droplet ejecting surface of the liquid jet head. An exposed area in the nozzle plate, which is not covered by the cover head, includes: nozzles provided respectively with water repellent films in peripheries of their nozzle orifices; and nozzles which have the same shape as the former nozzles, and which respectively have non-water repellent portions provided with no water repellent film in peripheries of their nozzle orifices.

6 Claims, 9 Drawing Sheets

LIQUID JET HEAD UNIT AND LIQUID JET DEVICE

CROSS-REFERENCE TO RELATED APPLICATIONS

This is a continuation of application Ser. No. 11/198,397 filed Aug. 8, 2005 which is now U.S. Pat. No. 7,328,965. Priority is claimed from JP 2004-234762 filed Aug. 11, 2004. The entire disclosures of the prior application, application Ser. No. 11/198,397, and the above-identified priority document, are hereby incorporated by reference.

BACKGROUND OF THE INVENTION

1. Field of the Invention

The present invention relates to a liquid jet head unit and a liquid jet device, both of which include a liquid jet head for ejecting liquid to be jetted. More specifically, the present invention relates to an inkjet recording head unit and an inkjet recording device, both of which include an inkjet recording head. In the inkjet recording head, a part of a pressure generating chamber communicating with a nozzle orifice, through which ink droplets are ejected, is constituted of a vibration plate. A piezoelectric element is provided thereto by use of this vibration plate. Ink droplets are ejected depending on displacement of the piezoelectric element.

2. Description of the Prior Art

Inkjet recording devices such as inkjet printers and plotters include an inkjet recording head unit (hereinafter referred to as a "head unit") provided with an inkjet recording head which can eject ink in the form of ink droplets, the ink reserved in an ink reserving portion such as an ink cartridge and an ink tank.

The unit head includes an inkjet recording head, a head case and a cover head. The inkjet recording head includes nozzle rows constituted of nozzle orifices which are arranged side by side in each of the nozzle rows. The head case is fixed to the inkjet recording head at the side of ink supply ports. The cover head protects a surface of the inkjet recording head, through which surface ink droplets are ejected (hereinafter, referred to as an "ink-droplet ejecting surface"). In this respect, a method of manufacturing a nozzle plate has been proposed. In the case of this method, a water repellent process is applied, by use of an electroless plating technique, to exposed parts in a nozzle plate constituting the inkjet recording head and an inner surface of each of the nozzle orifices. Thereby, coatings are formed on the exposed parts in the nozzle plate, and the inner surface of each of the nozzle orifices. (See Japanese Patent Laid-open Official Gazette No. Tokkai. Hei. 9-123461 (Scope of the claim, Page 3 and FIG. 1), for example)

However, if coatings (water repellent films) are provided to all of the exposed parts in the nozzle plate by means of applying the water repellent process to the exposed parts of the nozzle plate, this brings about a problem that the water repellent films make smaller adhesive strength with which the nozzle plate is adhered to another member in a case where the nozzle plate is fixed to the member with an adhesive agent interposed therebetween.

With this problem taken into consideration, another method of manufacturing a nozzle plate has been proposed. In the case of this method, the nozzle plate is provided with a water-repellent-processed surface which is obtained by applying a water repellent surface treatment, and a non-water repellent-processed surface in the periphery of the nozzle plate which is obtained by applying no water repellent surface treatment. This non-water repellent portion is adhered to, and joined to, a cover head with an adhesive agent interposed between the non-water repellent portion and the cover head. The cover head is shaped like a box, and covers the nozzle plate. (See Japanese Patent Laid-open Official Gazette No. Tokkai. Hei. 10-34920 (Page 3 and FIGS. 1 to 2), for example)

However, in a case where the water repellent film is formed on the nozzle plate as disclosed in Japanese Patent Laid-open Official Gazettes No. Tokkai. Hei. 9-123461 and No. Tokkai. Hei. 10-34920, this brings about a problem as follow. A ratio at which the minute nozzle orifices contrast with the areas provided with the water repellent films is low. This makes it difficult to identify the nozzle orifices. Accordingly, it is difficult to align the inkjet recording head with a holding member, such as a cartridge case to which an ink cartridge is attached, by use of the nozzle orifices.

In addition, there have existed head units, where nozzle rows in which nozzle orifices are arrange side by side are multiplied by use of a plurality of inkjet recording heads. Such head units require the nozzle rows of the neighboring inkjet recording heads to be relatively aligned with one another with high precision in order to improve printing quality. However, if the water repellent films are formed on the nozzle plate, this brings about a problem that the neighboring nozzle rows can not be relatively aligned with one another with high precision by use of the nozzle orifices. This is because it is difficult to identify the minute nozzle orifices.

It should be noted that such a problem exists not only in inkjet recording head units including inkjet recording heads for ejecting ink, but also in liquid jet head units including other liquid jet heads for ejecting liquid other than ink.

SUMMARY OF THE INVENTION

With the aforementioned problems taken into consideration, an object of the present invention is to provide a liquid jet head unit and a liquid jet device, which are capable of improving precision in aligning nozzle orifices, and can accordingly improve printing quality.

A first aspect of the present invention for achieving the object is carried out by a liquid jet head unit characterized by including: a liquid jet head having a nozzle plate provided with nozzle rows constituted of nozzle orifices through which liquid droplets are ejected, and which are arranged side by side; a head case fixed to the liquid jet head at the side of liquid supply ports; and a cover head provided to a liquid droplet ejecting surface of the liquid jet head. The liquid jet head unit is characterized in that an exposed area in the nozzle plate, which area is not covered by the cover head, includes: nozzles provided respectively with water repellent films in peripheries of their nozzle orifices; and nozzles which have the same shape as the former nozzles have, and which respectively have non-water repellent portions provided with no water repellent films in peripheries of their nozzle orifices.

The first aspect can improve visibility of the nozzles by use of the non-water repellent portions respectively in the peripheries of the nozzle orifices, and can easily align the nozzles with the liquid jet head, the cover head and the like with high precision.

A second aspect of the present invention is carried out by the liquid jet head unit according to the first aspect, characterized in that the brightness of the non-water repellent portions is 11 times or more as strong as brightness of the water repellent films.

The second aspect makes higher a ratio at which the non-water repellent portions contrast with the water repellent films, and thereby can improve visibility of the nozzles, the peripheries of whose nozzle orifices are not water-repellent.

A third aspect of the present invention is carried out by the liquid jet head unit according to any one of the first and the second aspects, characterized in that the water repellent films are made of a metal film.

The third aspect can improve visibility of the nozzles, the peripheries of whose nozzle orifices are not water-repellent even if the water repellent films are formed of a metal film.

A fourth aspect of the present invention is carried out by the liquid jet head unit according to any one of the first to the third aspects, characterized in that the cover head includes a junction portion which defines exposure opening portions through which the nozzle orifices are exposed, and which is joined to at least two end portions of a liquid-droplet ejecting surface of the liquid jet head, the two end portions outside of the nozzle rows.

The fourth aspect enables a plurality of liquid jet heads to be aligned with the cover head by use of the highly visible nozzles in a case where the plurality of liquid jet heads are intended to be fixed to the cover head. This makes it possible to relatively align the neighboring nozzle rows with high precision. In addition, this makes it possible to decrease a step difference between the cover head and the liquid-droplet ejecting surface, since the cover head is joined to the liquid-droplet ejecting surface. This makes it possible to prevent liquid from remaining in the ink-droplet ejecting surface even when the liquid-droplet ejecting surface is wiped or vacuumed. Since there is no interstice between the cover head and the liquid-droplet ejecting surface, this makes it possible to securely prevent a paper jam in which paper is jammed in an interstice which would otherwise occur, and makes it possible to securely prevent the cover head from being deformed. Moreover, this makes it possible to easily align the cover head and the plurality of nozzle rows with each other with high precision, accordingly enabling the cover head and the plurality of nozzle rows to be joined to each other.

A fifth aspect of the present invention is carried out by the liquid jet head unit according to any one of the first to the third aspects, characterized: by including a fixing plate having a junction portion which defines exposure opening portions through which the nozzle orifices are exposed, and which is joined to at least two end portions of the liquid-droplet ejecting surface of the liquid jet head, the two end portions outside of the nozzle rows, between the liquid jet head and the cover head; and in that the fixing plate and a surface in the liquid jet head, the liquid-droplet ejecting surface, are joined to each other, and thereby the plurality of liquid jet heads are fixed to the common fixing plate.

The fifth aspect enables the plurality of liquid jet heads to be aligned with the fixing plate by use of highly visible nozzles in a case where the plurality of liquid jet heads are intended to be aligned with the fixing plate. This makes it possible to relatively align the neighboring nozzle rows with high precision.

A sixth aspect of the present invention is carried out by a liquid jet device characterized by including the liquid jet head unit according to any one of the first to the fifth aspects.

The sixth aspect can realize the liquid jet device with improved printing quality and reliability.

DETAILED DESCRIPTION OF THE INVENTION

Detailed descriptions will be provided below for the embodiments of the present invention.

First Embodiment

Figure 1:
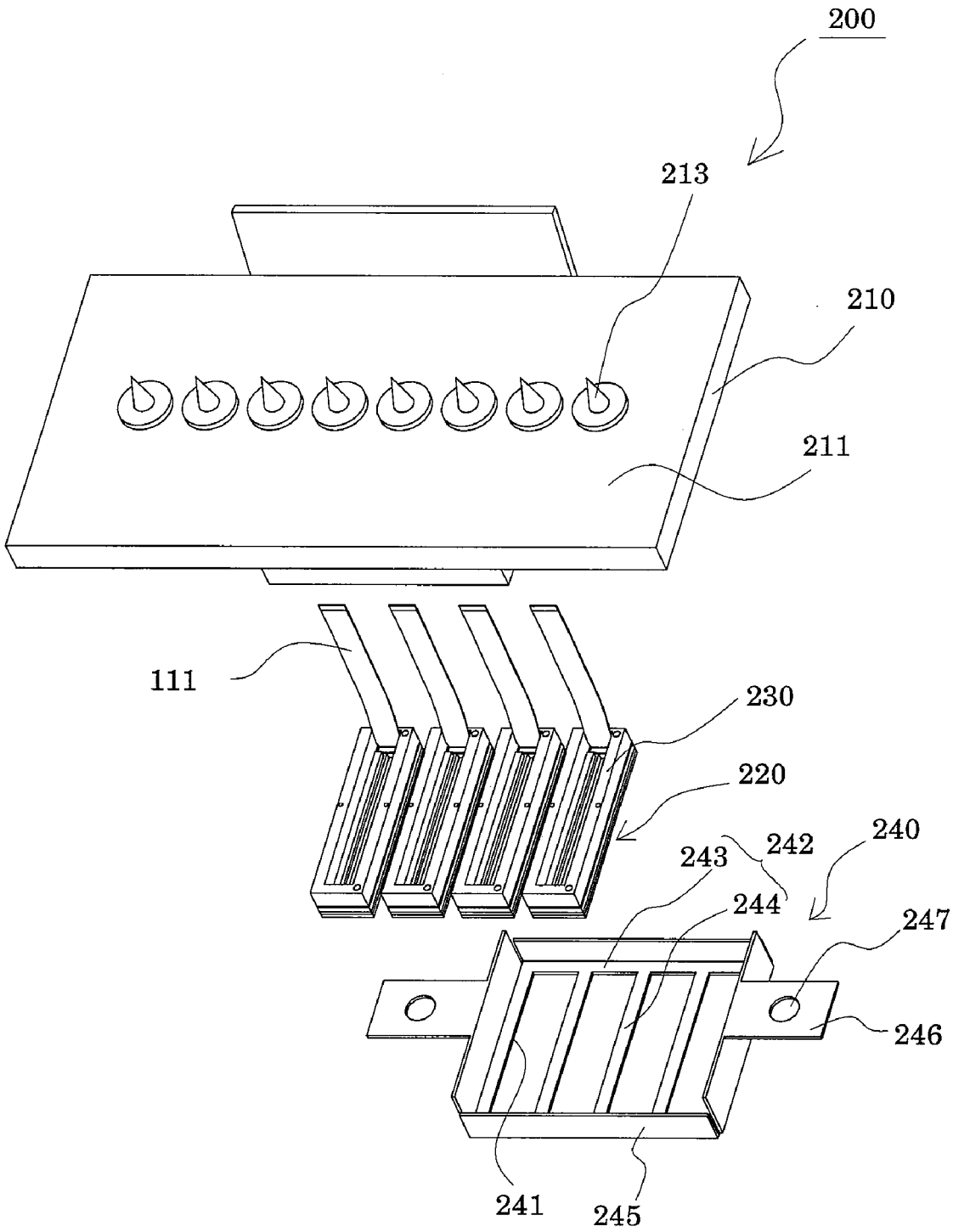
FIG. 1 is an exploded, perspective view of an inkjet recording head unit according to a first embodiment of the present invention.
Figure 2:
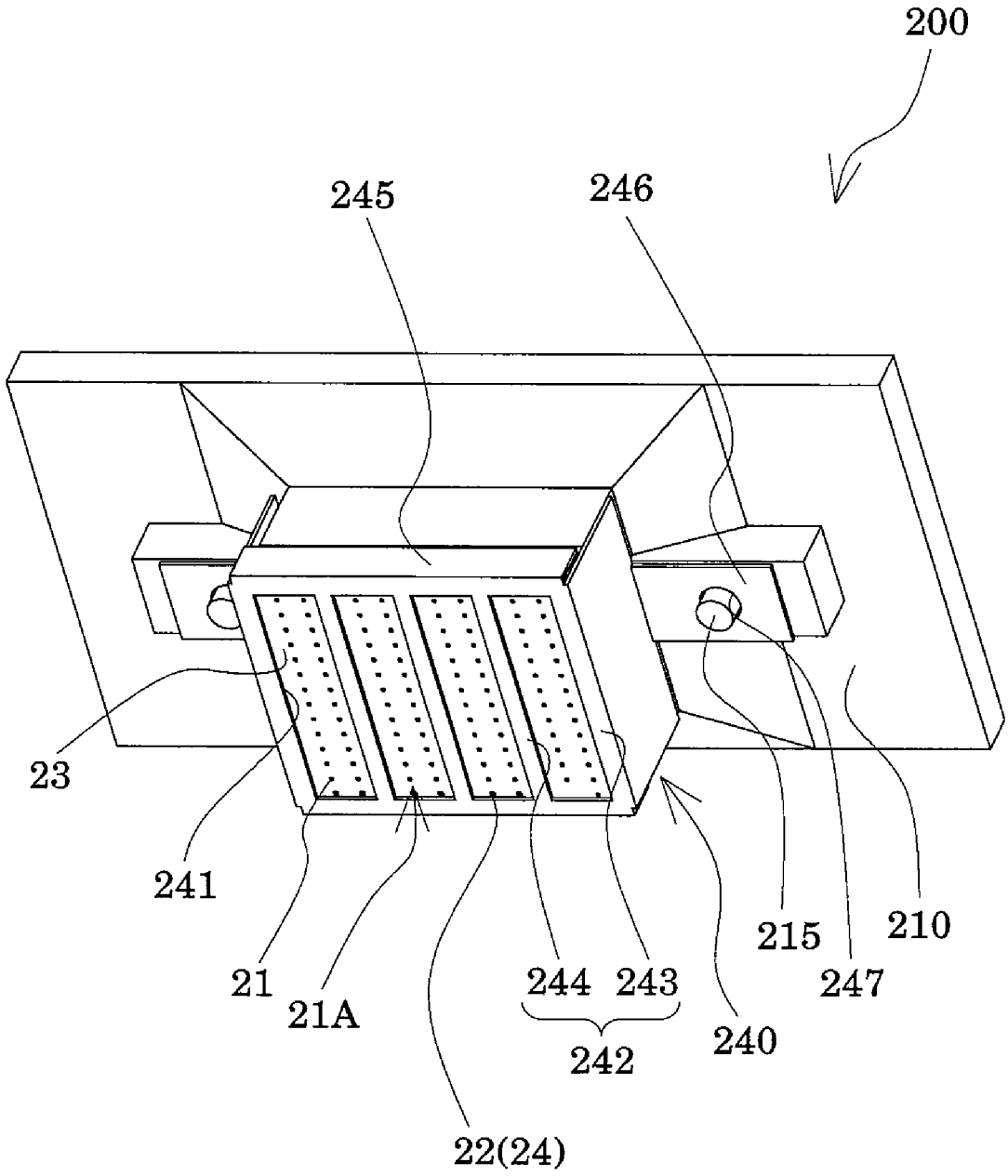
FIG. 2 is a perspective view which the inkjet recording head unit according to the first embodiment looks like when assembled.
Figure 3:
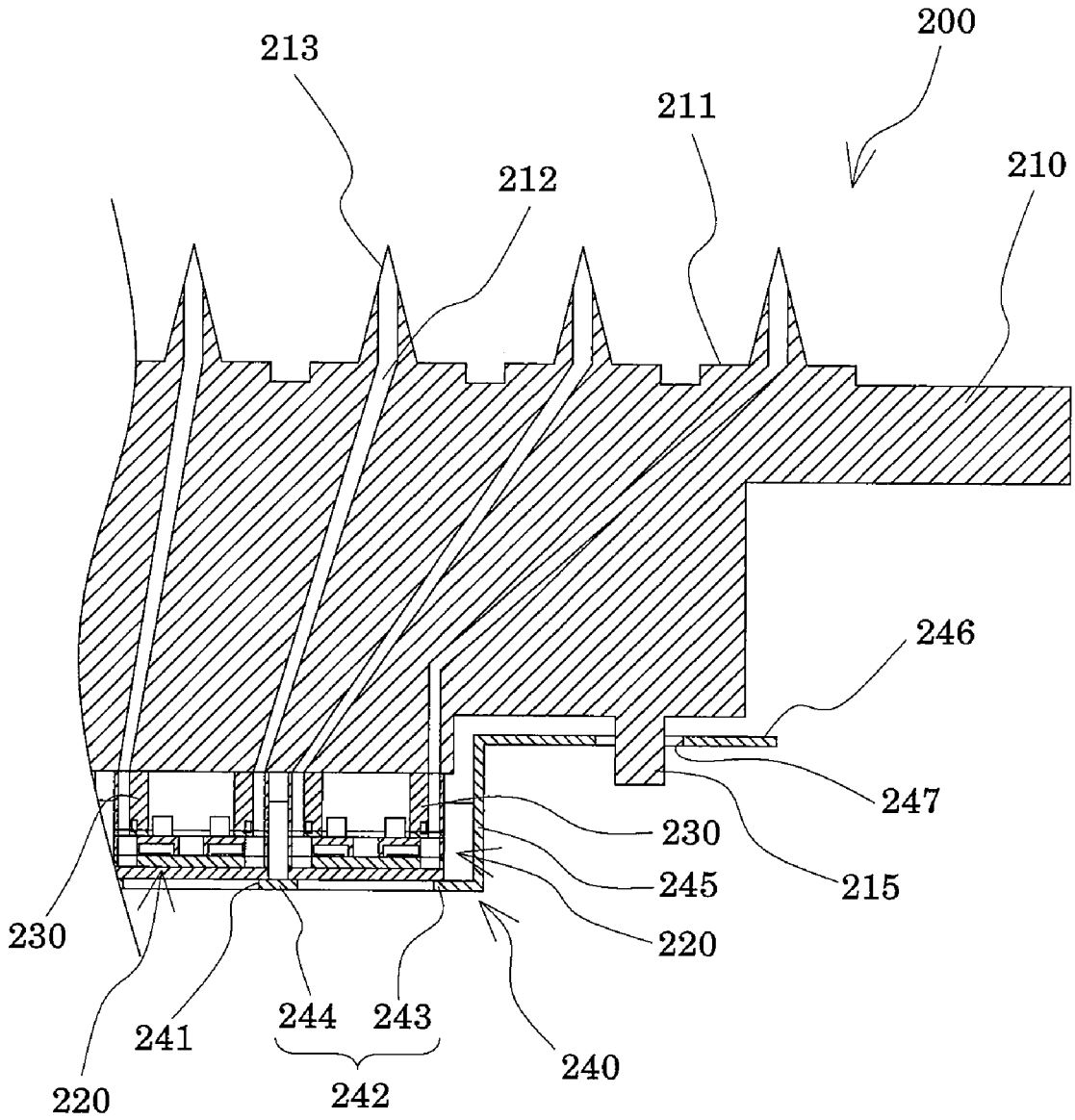
FIG. 3 is a cross-sectional view of a main part of the inkjet recording head unit according to the first embodiment.

FIG. 1 is an exploded, perspective view showing an inkjet recording head unit according to a first embodiment of the present invention. FIG. 2 is a perspective view which the inkjet recording head unit looks like when assembled. FIG. 3 is a cross-sectional view of the main part of the inkjet recording head unit. A cartridge case 210 is a supporting member constituting the inkjet recording head unit 200 (hereinafter referred to as a "head unit 200"). The cartridge case 210 includes cartridge attachment portions 211, and each of the ink cartridges (not illustrated) which are respectively means for supplying ink is attached to its corresponding cartridge attachment portion 211. In the case of the present invention, for example, the ink cartridges are constituted as separate containers, each of which is filled with any one of black ink and three color inks. The ink cartridges filled respectively with the black ink and three color inks are attached to the cartridge case 210. The bottom of the cartridge case 210 is provided with a plurality of ink communicating paths 212, as shown FIG. 3. One end of each of the ink communicating paths 212 is open to its corresponding one of the cartridge attachment portions 211. The other end of each of the ink communicating paths 212 is open to a head case, which will be described later. In addition, an ink supply needle 213 fixed to the opening portion of each of the ink communicating paths 212 of its corresponding cartridge attachment portion 211 with a filter (not illustrated) interposed between the ink supply needle 213 and the opening portion. The ink supply needles 213 are inserted respectively into ink supply ports of the ink cartridges. The filters are formed respectively in the ink communicating paths 212 for the purpose of removing bubbles and foreign objects from ink.

The cartridge case 210 configured as described above includes head cases 230 in its bottom surface. Inkjet recording heads 220 are fixed respectively to the head cases 230. Each of the inkjet recording heads 220 includes a plurality of piezoelectric elements 300, and ejects ink droplets from its nozzle orifice towards an end surface at the other side of the inkjet recording head facing the cartridge case 210, in response to the drive of its piezoelectric elements 300. In the case of the present invention, a plurality of inkjet recording heads 220 are provided for each of the black ink and the color inks. Each of the inkjet recording heads 220 ejects ink of its corresponding ink cartridge. A plurality of head cases 230 are provided respectively to the inkjet recording heads 220, and independently from one another.

Figure 4:
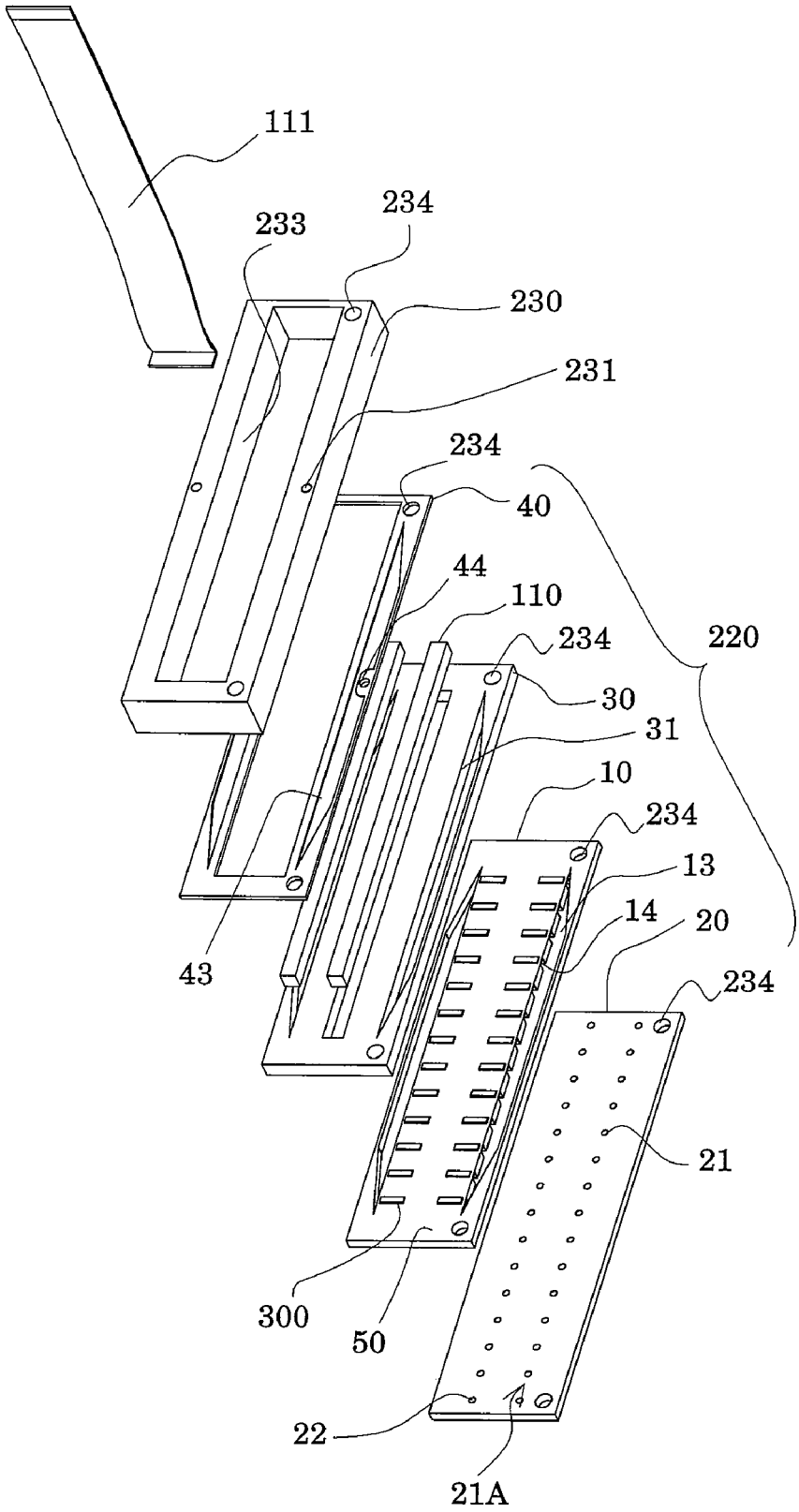
FIG. 4 is an exploded, perspective view of the main part of the inkjet recording head according to the first embodiment.
Figure 5:
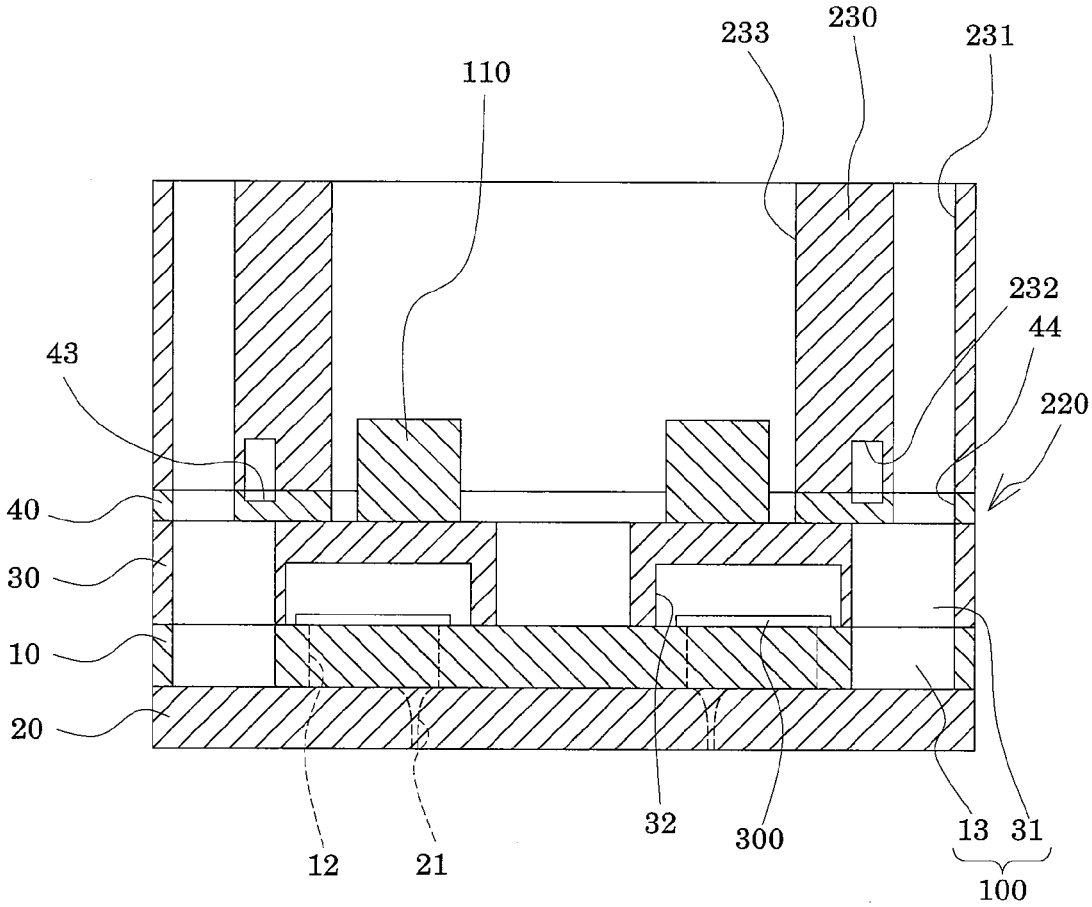
FIG. 5 is a cross-sectional view of a head case and a recording head according to the first embodiment.
Figure 6:
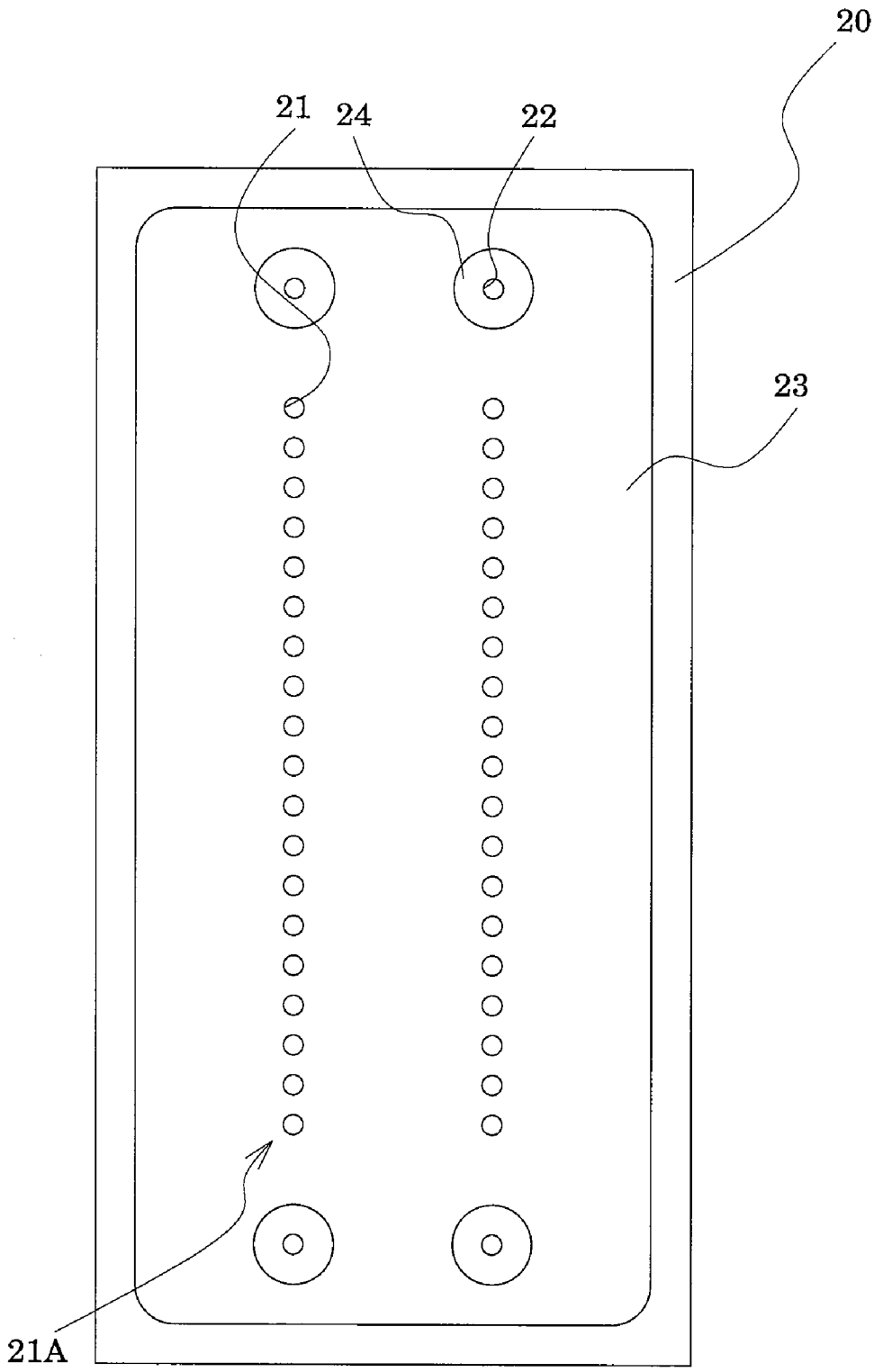
FIG. 6 is a plan view of a nozzle plate according to the first embodiment.

In this respect, descriptions will be provided for each of the inkjet recording heads 220 and each of the head cases 230 according to this embodiment, which are mounted onto the cartridge case 210. FIG. 4 is an exploded, perspective view of the inkjet recording head and the head case. FIG. 5 is a cross-sectional view of the inkjet recording head and the head case. In the case of this embodiment, as shown in FIGS. 4 and 5, a passage-forming substrate 10 constituting each of the inkjet recording heads 220 is formed of a single crystal silicon substrate. In addition, an elastic film 50 made of silicon dioxide is formed on one surface of the passage-forming substrate 10, the elastic film 50 having been beforehand formed by a thermal oxidation process. Pressure generating chambers 12 are formed on this passage-forming substrate 10 in two rows, which are arranged in parallel with each other in the width direction of the passage-forming substrate, by anisotropically etching the passage-forming substrate from the other surface of the passage-forming substrate 10. Each of the pressure generating chambers 12 is defined by a plurality of compartment walls. A communicating portion 13 is formed in the outside of each of the two rows of pressure-generating chambers 12 in the longitudinal direction of the pressure-generating chambers 12. Each of the communicating portions 13 communicates with a reservoir portion 31 provided to a reservoir-forming plate, which will be described later. In addition, the communicating portion 13 constitutes a reservoir 100 which is a common ink chamber for the pressure generating chambers 12. Furthermore, each of the communicating portions 13 communicates with one end of each of the pressure-generating chambers 12 in the corresponding row, the end located in longitudinal direction of the pressure generating chamber 12, through its corresponding ink supply path 14.

A nozzle plate 20 is fixed, with an adhesive agent, a thermal adhesive film or the like, onto a surface of the passage-forming substrates 10, the surface in which openings are made. Nozzle orifices 21 are drilled in the nozzle plate 20, and the nozzle orifices 21 communicate respectively with the ink supply paths 14 of the pressure generating chambers 12 at the other sides of the pressure generating chambers 12 facing the ink supply paths 14. In other words, one inkjet recording head is provided with two nozzle rows 21A in which nozzle orifices 21 are arranged side by side. Incidentally, the nozzle plate 20 is, for example, 0.01 mm to 1 mm in thickness. The nozzle plate 20 is made of glass ceramics, a single crystal silicon plate, stainless steel, or the like, whose coefficient of linear expansion is, for example, 2.5 to 4.5 [$10^{-6}$/° C.] at 300° C.

In this regard, the nozzle plate 20 is with dummy nozzles 22 in the respective positions which communicate with no pressure generating chambers 12. The dummy nozzles 22 have the same shape as the nozzle orifices 21. The dummy nozzles 22 are provided to the respective positions which are away from their neighboring nozzle orifices 21 with a distance which is N times as long as a pitch between each neighboring two of the nozzle orifices 21. The dummy nozzles 22, which will be described in detail later, are used when the inkjet recording heads 220 and a cover head 240 are intended to be aligned with, and fixed to, each other. In the case of this embodiment, the dummy nozzles 22 are provided to the two opposite sides of each of the two nozzle rows 21A in a direction which makes the nozzle orifices 21 in the row 21A arranged side by side. In other words, each of the nozzle plates 20 is provided with four dummy nozzles 22 in the case of this embodiment.

It should be noted that the number of dummy nozzles 22 in the nozzle plate 20 is not limited to this in particular. It suffices if two dummy nozzles 22 exist in each of the nozzle plates 20. In a case where the nozzle plate 20 is intended to be provided with two dummy nozzles 22, it is advantageous that one dummy nozzle be provided to the nozzle plate 20 at each of the two opposite sides of the nozzle rows 21A in a direction which makes the nozzle orifices 21 of each of the nozzle rows 21A arranged side by side. This makes it possible to easily and precisely align the inkjet recording head 220 and the cover head 240 with each other by means of the dummy nozzles 22. In addition, if the dummy nozzles 22 have the same shape as the nozzle orifices 21, and if the dummy nozzles 22 are provided respectively in positions which are away from their neighboring nozzle orifices 21 with a distance which is N times as long as a pitch between each pair of nozzle orifices 21, this makes it possible to precisely form the dummy nozzles 22 on each of the nozzle plates 20 by use of the same tools as the nozzle orifices are formed, the tools including pins.

Moreover, each of the nozzle plates 20 is provided with a water repellent film 23 on an ink-droplet ejecting surface. What can be listed as the water repellent film 23 are a metallic film including a high polymer molecule containing fluorine, a plasma polymerized film which is obtained by polymerizing siloxane or the like by means of plasma, and their equivalent. The water repellent film 23 made of a metallic film can be precisely formed with a predetermined thickness, for example, by a eutectic plating process. In addition, the water repellent film 23 made of a plasma polymerized film can be formed by use of a plasma polymerizing system through the following process. A noble gas and a gas having an oxidation power are mixed with a material gas obtained by gasifying siloxane. The noble gas includes argon and helium. The gas having the oxidizing power includes oxygen and carbon dioxide. These materials are polymerized. It should be noted that, in the case of this embodiment, the water repellent film 23 is formed by plating fluorine resin on the nozzle plate 20, made of stainless steel, in a eutectic manner.

In a case where the nozzle plate 20 and the cover head 240, which will be described in detail later, are jointed to each other, an adhesive strength of the adhesive agent decreases with the water repellent film 23. The water repellent film 23 as described above is provided only in areas in the cover head 240, which areas are exposed through exposure opening portions 241. In other words, in order that the cover head 240 can be jointed to a circumferential portion covering a periphery of the nozzle plate 20, the water repellent film 23 is provided to areas in the nozzle plate 20, which areas are other than regions in the nozzle plate 20 which are joined to the cover head 240. Details for this will be described later.

In addition, regions corresponding respectively to the dummy nozzles 22 in the ink-droplet ejecting surface of the nozzle plate 20 are non-water repellent portions 24 to which the water repellent film 23 is not provided. In the case of this embodiment, the region in the outer periphery of a part where each of the dummy nozzles 22 is open is provided with the non-water repellent portion 24, which is shaped like a circle. If the non-water repellent portion 24 is provided to the region corresponding to one of the dummy nozzles 22 in the nozzle plate 20 in this manner, this makes it possible to make the brightness of the non-water repellent portion 24 stronger than that of the water repellent film 23. In other words, this makes it possible to make higher a contrast ratio of the non-water repellent portion 24, accordingly making it possible to improve the visibility performance of the dummy nozzle 22.

Note that it is advantageous that the non-water repellent portions 24 be 0.4 mm or larger in diameter. This is because, in a case where the water repellent portions 23 and the non-water repellent portions 24 are intended to be formed by the eutectic plating process, if resists respectively of the regions which constitute the non-water repellent portions 24 are smaller than 0.4 mm in diameter, the resists come off during the plating process. Accordingly, the non-water repellent portions 24 are plated, too.

In addition, it is advantageous that the non-water repellent portions 24 be formed so as to have a relatively small area. This is because, for example, if the non-water repellent portions 24 are large, this makes ink likely to remain in the non-water repellent portions 24. The remaining ink increases its viscosity. Accordingly, when the nozzle plate 20 is wiped, the ink with the increased viscosity adheres to the wiper. If the nozzle orifices 21 are wiped by use of the wiper to which the ink with the increased viscosity adheres, the ink with the increased viscosity enters the nozzle plate 20 though the nozzle orifices 21. This causes the nozzle orifices 21 to be blocked or causes other trouble. In other words, it is advantageous that the non-water repellent portions 24 be formed so as to be 0.4 mm or larger in diameter, but so as to be as small as possible. It is preferable that the non-water repellent portions 24 be 0.4 mm to 0.5 mm in diameter.

Additionally, the non-water repellent portions 24 as described above can be formed in the following manner. For example, the nozzle orifices 21 and the dummy nozzles 22 are formed in the nozzle plate 20. Thereafter, the regions which will later constitute the non-water repellent portions are provided with the respective resists. Then, the water-repellent film 23 is formed by the eutectic plating process. Subsequently, the resists are removed.

In this respect, in a case where the water repellent film 23 made of fluoride resin is formed on the nozzle plate 20 made of stainless steel, this makes it possible to make the brightness of the non-water repellent portions 24 more than eleven times as strong as the brightness of the water repellent film 23. If a contrast ratio of the water repellent portions 24 is made higher in this manner, this makes it possible to improve the visibility performance of the dummy nozzles 22. Accordingly, the inkjet recording head 220 and the cover head 240 can be aligned easily with higher precision. Incidentally, the brightnesses respectively of the non-water repellent portions 24 and the water repellent film 23 are measured when light is irradiated to the nozzle plate 20 and concurrently an image which is obtained by photographing the nozzle plate 20 is displayed on a display screen. The nozzle plate 20 is monitored through the display screen in the case where the inkjet recording head 220 and the cover head 240 are intended to be aligned with, and fixed to, each other.

Meanwhile, a lower electrode film, piezoelectric elements 300 are formed on the elastic film 50 at the other side of the passage-forming substrate 10 facing the surface in which openings are made. The piezoelectric elements 300 are formed by sequentially laminating a lower electrode film, a piezoelectric layer and an upper electrode film on the elastic film 50. The lower electrode film is made of metal. The piezoelectric layer is made of lead zirconate titanate (PZT) or the like. The upper electrode film is made of metal. A reservoir forming plate 30 is joined onto the passage-forming substrate 10 on which the piezoelectric elements 300 are formed as described above. The reservoir forming plate 30 includes the reservoir portions 31 constituting at least parts of the reservoir 100. In the case of this embodiment, the reservoir portions 31 are formed in a way that each of the reservoir portions 31 penetrates through the reservoir forming plate 30 in the thickness direction of the reservoir forming plate 30, and in a way that each of the reservoir portions 31 extends in the width direction of the pressure generating chambers 12. Each of the reservoir portions 31 communicates with its corresponding communicating portion 13, and constitutes the reservoir 100 which is a common ink chamber for the pressure generating chambers 12.

Furthermore, piezoelectric element holding portions 32 are provided to regions in the reservoir forming plate 30, which regions are opposite to the piezoelectric elements 300. Each of the piezoelectric element holding portions 32 includes a hollowed space large enough not to obstruct movements of the piezoelectric elements 300. What can be listed as a material for the reservoir forming plate 30 as described above is glass, ceramic, metal, plastic or the like. It is advantageous that a material whose coefficient of thermal expansion is approximately equal to that of the passage-forming substrate 10 be used for the reservoir forming plate 30. In the case of this embodiment, the reservoir forming plate 30 is formed by the same material as the passage-forming substrate 10, and the material is a single crystal silicon substrate.

Driver ICs 110 for driving the piezoelectric elements 300 are provided onto the reservoir forming plate 30. Terminals of these driver ICs 110 are connected with drawn-out interconnects, which are drawn out from individual electrodes of the piezoelectric elements 300, through bonding wires (not illustrated) or the like. In addition, the terminals of the driver ICs 110 are connected with the outside through external interconnects 111 such as flexible print cables (FPCs) as shown in FIG. 1. Accordingly, the terminals of the driver ICs 110 are designed to receive various signals, such as signals for printing, from the outside through the external interconnects 111.

A compliance plate 40 is joined to the top of the reservoir forming plate 30 as described above. Ink introducing ports 44 for supplying ink to the reservoirs 100 are formed in the respective areas in the compliance plate 40, which areas are opposite to the reservoirs 100, in a way that the ink introducing ports 44 penetrate through the compliance plate 40 in the thickness direction of the compliance plate 40. Regions in the compliance plate 40 opposite to the reservoirs 100, except for the areas where the ink introducing ports 44 are formed, are flexible portions 43 which are formed so that the flexible portions 43 are thin in the thickness direction. The reservoirs 100 are sealed off by the flexible portions 43. These flexible portions 43 provide compliance to the inside of the reservoirs 100.

The inkjet recording head 220 is configured of the nozzle plate 20, the passage-forming substrate 10, the reservoir forming plate 30 and the compliance plate 40, as described above. In addition, the head case 230 is provided to the top of the compliance plate 40 of the inkjet recording heads 220. The head case 230 is provided with ink supply communicating paths 231. Each of the ink supply communicating paths 231 communicates with its corresponding ink introducing port 44, and communicates with its corresponding ink communication path 212 of the cartridge case 210. Thereby, each of the ink supply communicating path 231 supplies ink from the cartridge case 210 to its corresponding ink introducing port 44. The head case 230 is provided with concave portions 232 respectively in areas in the head case 230, which areas are opposite to the flexible portions 43. Accordingly, each of the flexible portions 43 is designed to perform flexure deformation whenever necessary. Furthermore, the head case 230 is provided with a driver IC holding portion 233 in an area in the head case 230, which area is opposite to the driver ICs 110 provided on the reservoir forming plate 30. The driver IC holding portion 233 penetrates through the head case 230 in the thickness direction of the head case 230. The external interconnect 111 is inserted into the driver IC holding portion 233, and accordingly is connected to the driver ICs 110.

The inkjet recording head 220 according to this embodiment as described above takes in ink in the ink cartridges from the ink introducing ports 44 through the ink communicating paths 212 and the ink supply communicating paths 231. Thus, the interior of the inkjet recording head 220 is filled with ink, the interior ranging from the reservoirs 100 to the nozzle orifices 21. Thereafter, the inkjet recording head 220 applies voltage to the piezoelectric elements 300 corresponding respectively to the pressure generation chambers 12 in accordance with signals for printing from the driver ICs 110. Hence, the inkjet recording head 220 causes the elastic film 50 and the piezoelectric elements 300 to perform flexure deformation. This raises pressures respectively in the pressure-generating chambers 12, accordingly causing ink droplets to be ejected from the nozzle orifices 21.

Each of the members and the head case 230 constituting the inkjet recording head 220 as described above are provided with pin-insertion holes 234 respectively in their two corners. Pins are inserted respectively into the pin-insertion holes 234, and the pins are used for aligning the members with one another when assembled. Accordingly, the members are joined to one another while the members are relatively aligned by means of inserting the pins respectively into the pin-inserted holes 234. Thus, the inkjet recording head 220 and the head case 230 are formed in an integrated manner.

It should be noted that the inkjet recording head 220 is built through the following process. A multiple of chips are simultaneously formed on one silicon wafer. Then, the nozzle plates 20 and the compliance plates 40 are adhered to the silicon wafer. Accordingly, the nozzle plates 20, the compliance plates 40 and the silicon wafer are formed into a unified whole. Thereafter, the unified whole is divided by each of the passage-forming substrates 10, as shown in FIG. 4, whose sizes are equivalent to those of the chips. Each of the unified whole thus divided are formed into the inkjet recording heads 220.

Such four inkjet recording heads 220 and such four head cases 230 are fixed to the cartridge case 210 at predetermined intervals in the direction which makes each of the nozzle rows 21A aligned. This means that the head unit 200 according to this embodiment is provided with 8 nozzle rows 21A. If the nozzle rows 21A of the nozzle orifices 21 arranged side by side are intended to be multiplied by use of the plurality of inkjet recording heads 220 for one head unit 200, this makes it possible to prevent reduction in yields in comparison with a case where a multiple of nozzle rows 21A are formed in a single inkjet recording head 220. Furthermore, if the plurality of inkjet recording heads 220 is used for one head unit 200 for the purpose of multiplying the nozzle rows 21A, this makes it possible to increase the number of inkjet recording heads 220 which can be formed from one silicon wafer. This makes it possible to cut back on unused areas of the silicon wafer, thus enabling manufacturing costs to be reduced.

As shown in FIGS. 1 and 2, moreover, the four inkjet recording heads 220 held by the cartridge case 210 by use of the respective head cases 230 are relatively aligned with one another by the cover head 240 which is shaped like a box in a way that the cover head 240 covers the four inkjet recording heads 220. Thus, the four recording heads 220 are held by the cartridge case 210. The cover head 240 includes the exposure opening portions 241 and a junction portion 242. The nozzle orifices 21 and the dummy nozzle 22 are exposed through the exposure opening portions 241. The junction portion 242 defines the exposure opening portions 241, and is joined to at least two end portions of the liquid-droplet ejecting surface of each of the inkjet recording heads 220, the two end portions outside of nozzle orifices arranged side by side in the nozzle rows 21A.

In the case of this embodiment, the junction portion 242 is constructed of a frame portion 243 and beam portions 244. The frame portion 243 is provided to the periphery of the surface through which to eject ink droplets, across the plurality of inkjet recording heads 220. Each of the beam portions 244 is provided, in an extending manner, between each two neighboring inkjet recording heads 220. The beam portions 244 separate the exposure opening portions. The frame portion 243 and the beam portions 244 are joined to the surface of each of the inkjet recording heads 220, through which surface eject ink droplets are ejected. The frame portion 243 of the junction portion 242 is formed in a way that the frame portion 243 seals off the pin-insertion holes 234 for aligning the members with one another during the manufacturing process. Additionally, the cover head 240 includes a side wall portion 245. The side wall portion 245 is provided, in an extending manner, to side parts of the ink-droplet ejecting surface of the inkjet recording head 220, in a way that the side wall portion 245 is bent along the peripheral portion of the ink-droplet ejecting surface.

In this manner, the cover head 240 is designed to cause the junction portion 242 to be adhered to the ink-droplet ejecting surface of the inkjet recording head 220. This makes it possible to decrease a step difference between the cover head 240 and the ink-droplet ejecting surface. This makes it possible to prevent ink from remaining in the ink-droplet ejecting surface even when the ink-droplet ejecting surface is wiped or vacuumed. In addition, an interstice between each two neighboring inkjet recording heads 220 is sealed off by its corresponding beam portion 244. Accordingly, ink does not enter the interstice between each two neighboring inkjet recording heads 220. This makes it possible to prevent the piezoelectric elements 300 and the driver ICs 110 from being deteriorated and broken down due to ink which would otherwise enter the interstice. Furthermore, the cover head 240 and the ink-droplet ejecting surface of the inkjet recording head 220 are closely adhered to each other by use of an adhesive agent. This makes it possible to prevent a recorded medium from entering the interstice which would otherwise exist. This makes it also possible to prevent the cover head 240 from being deformed, as well as to prevent paper from being jammed. Moreover, the side wall portion 245 covers the outer peripheral portion of the plurality of inkjet recording heads 220. This makes it possible to securely prevent the spread of ink along sides of the plurality of inkjet recording heads 220, which would otherwise occur. Furthermore, the cover head 240 is provided with the junction portion 242 joined to the ink-droplet ejecting surfaces respectively of the inkjet recording heads 220. This makes it possible to precisely align each nozzle row 21A of each of the plurality of inkjet recording heads 220 with the cover head 240. Accordingly, the inkjet recording heads 220 are precisely joined to the cover head 240.

What can be listed as a material for cover head 240 is a metal material such as stainless steel. The cover head 240 may be formed by pressing the metal material, or by molding the metal material. Additionally, if the cover head 240 is made of a conductive metal material, this makes it possible to ground the cover head 240. Incidentally, no specific limitation is imposed on the junction between the cover head 240 and the nozzle plate 20. What can be listed as adhesion for the junction is adhesion by use of an adhesive agent such as thermosetting epoxy adhesive agent, an ultraviolet-curing adhesive agent or the like.

The junction portion 242 includes flange portions 246 provided respectively with fixing holes 247 to be used for the cover head 240 to be aligned with, and fixed to, the other members. These flange portions 246 are provided to the junction portion 242 so that these flange portions 246 are bent from the side wall portion 245 in a way that these flange portions 246 protrude from the side wall portion 245 in the same surface direction as the ink-droplet ejecting surface spreads. In the case of this embodiment, the cover head 240 is fixed to the cartridge case 210 which is a holding member for holding the inkjet recording heads 220 and the head cases 230, as shown in FIGS. 2 and 3. More specifically, the cartridge case 210 is provided with protrusions 215 which protrude towards the ink-droplet ejecting surface, and which is inserted respectively into the fixing holes 247 of the cover head 240, as shown in FIGS. 2 and 3. The cover head 240 is fixed to the cartridge case 210 by inserting these protrusions 215 into the fixing holes 247 of the cover head 240, and concurrently by crimping the extremities respectively of the protrusions 215 by means of heating the extremities. If such protrusions 215 provided to the cartridge case 210 are designed to be smaller in external diameter than the fixing holes 247 of the flange portions 246, this makes it possible to align the cover head 240 with the cartridge case in the same surface direction as the ink-droplet ejecting surface spreads. Thereby, the cover head 240 can be fixed to the cartridge case 210.

In addition, such cover head 240 and each of the inkjet recording heads 220 are fixed to each other through aligning the fixing holes 247 of the cover head 240 and the plurality of nozzle rows 21A with one another. In this respect, the fixing holes 247 of the cover head 240 and the nozzle rows 21A of each of the inkjet recording heads 220 can be aligned with one another, for example, by use of an alignment jig made of a transparent sheet member such as glass, since the cover head 240 is joined to the ink-droplet ejecting surface of each of the inkjet recording heads 220.

Figure 7A:
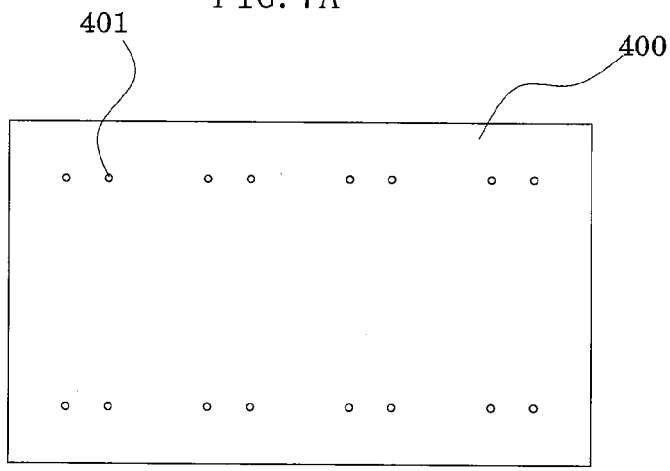
FIGS. 7A to 7C are plan views respectively showing steps of manufacturing the inkjet recording head unit according to the first embodiment.
Figure 7B:
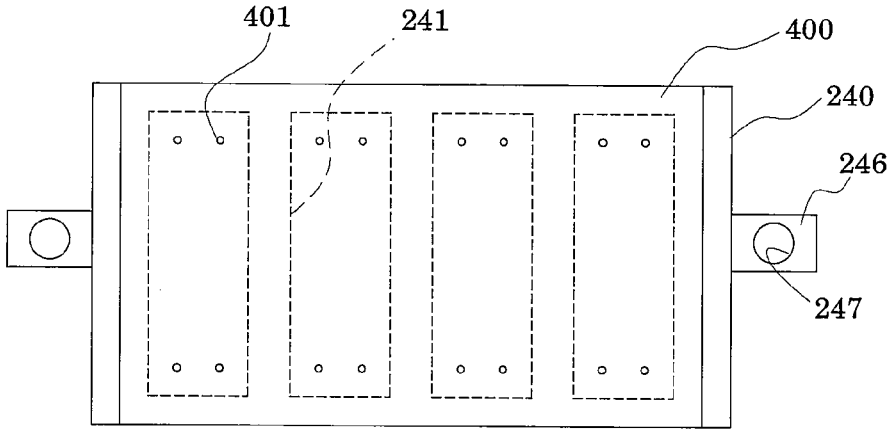

At this point, descriptions will be provided for a method of manufacturing the cover head 240 and the inkjet recording heads 220 using the alignment jig. Incidentally, FIGS. 7A to 7B are plan views respectively showing steps of manufacturing the head unit. As shown in FIG. 7A, the alignment jig 400 is made of a transparent sheet member such as glass. The alignment jig 400 is provided in a way that the dummy nozzles 22 of the nozzle plate 20 and alignment marks 401 to be used for the alignment are put in their respective predetermined positions. In the case of this embodiment, each of the inkjet recording heads 220 is provided with four dummy nozzles 22. For this reason, the alignment jig 400 is provided with four alignment marks 401 in an area corresponding to each of the inkjet recording heads 220. In other words, the alignment jig 400 is provided with 16 alignment marks 401 in total.

As shown in FIG. 7B, first of all, the periphery of the alignment jig 400 and the periphery of the cover head 240 are aligned with each other. Thereby, the alignment jig 400 and the fixing holes 247 of the cover head 240 are aligned with each other. In the case of this embodiment, the alignment jig 400 and the fixing holes 247 of the cover head 240 are aligned with each other through aligning the periphery of the alignment jig 400 and the periphery of the cover head 240 with each other. However, the alignment is not limited to this. For example, the alignment jig 400 may be provided with protrusions to be inserted into the fixing holes 247 of the cover head 240, and accordingly the alignment jig 400 and the cover head 240 may be aligned with each other by means of inserting the protrusions respectively into the fixing holes 247. Otherwise, the alignment jig 400 may be provided with through-holes into which pins to be used for the alignment are inserted, and accordingly, the alignment jig 400 and the cover head 240 may be aligned with each other by means of inserting each of the alignment pins into its corresponding through-hole and its corresponding fixing hole 247.

Figure 7C:
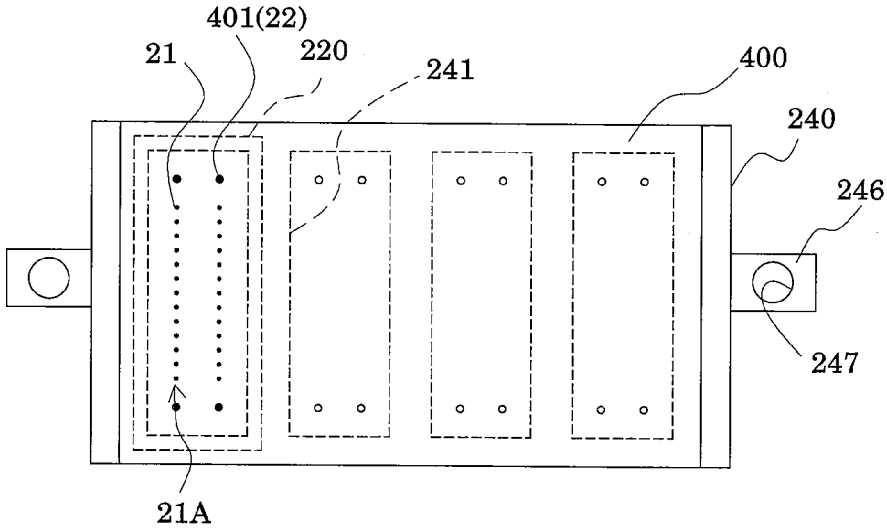

Subsequently, as shown in FIG. 7C, the alignment jig 400 is looked through from a side opposite to the cover head 240 across the alignment jig. Thereby, positions respectively of the dummy nozzles 22 of a first inkjet recording head 220 are aligned with the alignment marks 401. These dummy nozzles 22 are through-holes penetrating the nozzle plate 20. This causes these dummy nozzles 22 to be displayed with weak brightness against the background of their respective non-water repellent portions 24 to be displayed with strong brightness. This makes the dummy nozzles 22 easily visible. Accordingly, the alignment can be performed easily with high precision. In this case, an adhesive agent is applied beforehand to the junction surface of the cover head 240, to which junction surface the inkjet recording heads 220 are joined. When the nozzle rows 21A of the first inkjet recording head 220 are aligned with one another, the first inkjet recording head 220 and the cover head 240 are concurrently joined to each other. Incidentally, the positions respectively of the dummy nozzles 22 are aligned with the alignment marks 401, in practice, by irradiating beams of light to the nozzle plate 20 from above the alignment jig 400 and by thus displaying a photographed image of the nozzle plate 200 on the display screen.

In this respect, as described above, a thermosetting adhesive agent or an ultraviolet-curing adhesive agent can be used as an adhesive agent with which to join the inkjet recording head 220 and the cover head 240 to each other. In a case where a thermosetting adhesive agent is used, the cover head 240 and the inkjet recording head 220 are joined to each other through the following process. The adhesive agent is applied to the cover head 240. Thereafter, the cover head 240 and the inkjet recording head 220 are made to abut to each other. The adhesive agent is hardened while a predetermined pressure is being applied to the cover head 240 and the inkjet recording head 220. On the other hand, in a case where an ultraviolet-curing adhesive agent is used, the cover head 240 and the inkjet recording head 220 are joined to each other through the following process. The adhesive agent is applied to the cover head 240. Thereafter, the adhesive agent is hardened by irradiating beams of ultraviolet light to the cover head 240 and the inkjet recording head 220 while the cover head 240 and the inkjet recording head 220 are being made to abut to each other. At this time, unlike the thermosetting adhesive agent, the ultraviolet-curing adhesive agent does not have to be hardened while a predetermined pressure is being applied to the cover head 240 and the inkjet recording head 220. This makes it possible to prevent a misalignment between the inkjet recording head 220 and the cover head 240 which would otherwise stem from the pressure application. Accordingly, the inkjet recording head 220 and the cover head 240 can be joined to each other with high precision. Moreover, in the case of the junction by use of the ultraviolet-curing adhesive agent, the junction strength is relatively small. For this reason, after the cover head 240 and the inkjet recording head 220 are joined to each other by use of the ultraviolet-curing adhesive agent, it is better that peripheries, such as corners, which are defined by the inkjet recording head 220 and the cover head 240 should be fixed to each other by the thermosetting adhesive agent. This makes it possible to firmly join the inkjet recording head 220 and the cover head 240 to each other with high precision, accordingly enabling reliability to be improved.

Thereafter, the process shown in FIG. 7C is performed repeatedly. Thereby, the rest of the plurality of inkjet recording heads 220 are sequentially fixed to the cover head 240. If the cover head 240 and the dummy nozzles 22 are joined to each other by aligning the cover head 240 and the dummy nozzles 22 with each other in this manner, this makes it possible to align the cover head 240 and the nozzle rows 21A with each other with high precision. Concurrently, this makes it possible to relatively align the neighboring nozzle rows 21A of the plurality of inkjet recording heads 220 with one another with high precision. Thereby, printing quality can be improved. Additionally, in a case where the cover head 240 is fixed to the cartridge case 210 by aligning the position of the cover head 240 with the cartridge case 210 by use of the fixing holes 247, the positions in which the fixing holes 247 and the nozzle rows 21A are concurrently aligned. This makes it possible to easily align the cartridge case 210 and the nozzle rows 21A with high precision.

It should be noted that, after the cover head 240 and the plurality of inkjet recording heads 220 are joined to each other through aligning the cover head 240 and the plurality of inkjet recording heads 220 with each other in the aforementioned steps, the head unit 200 according to this embodiment can be formed through the following process. The head cases 230 are joined to the cartridge case 210, each of the head cases 230 having been joined to a part of the inkjet recording head 220, in which part the ink introducing ports 44 are formed. Concurrently, the fixing holes 247 of the cover head 240 are fixed respectively to the protrusions 215 of the cartridge case 210.

Figure 8:
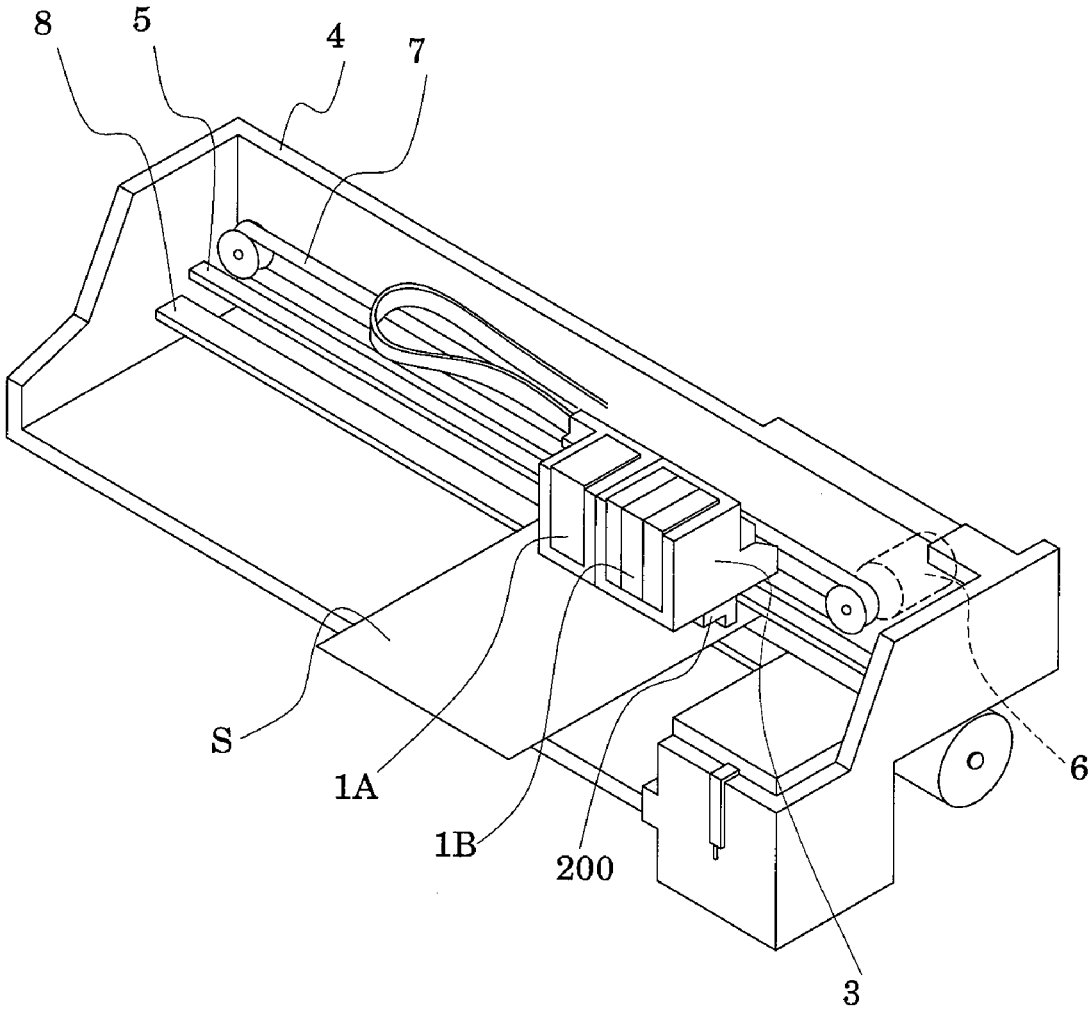
FIG. 8 is a schematic view of the inkjet recording device according to the first embodiment.

Such a head unit 200 is mounted onto an inkjet recording device. FIG. 8 is a schematic view showing an example of the inkjet recording device. As shown in FIG. 8, cartridges 1A and 1B are provided detachably to the head unit 200 including the inkjet recording heads. The cartridges 1A and 1B constitute means for supplying ink. A carriage 3 on which this head unit 200 is mounted is provided to a carriage shaft 5 movably in the axis direction of the carriage shaft 5. The carriage shaft 5 is fixed to a device main body 4. Each of these cartridges 1A and 1B are designed to eject compositions of the black ink and compositions of the color inks.

In addition, drive power of the drive motor 6 is transmitted to the carriage 3 through a plurality of gears (not illustrated) and a timing belt 7. This causes the carriage 3, on which the head unit 200 is mounted, to move along the carriage shaft 5. On the other hand, the device main body 4 is provided with a platen 8 along the carriage shaft 5. Recording sheets S, which are recording media such as sheets of paper fed by a feed roller (not illustrated), are designed to be transferred on the platen 8.

Second Embodiment

Figure 9:
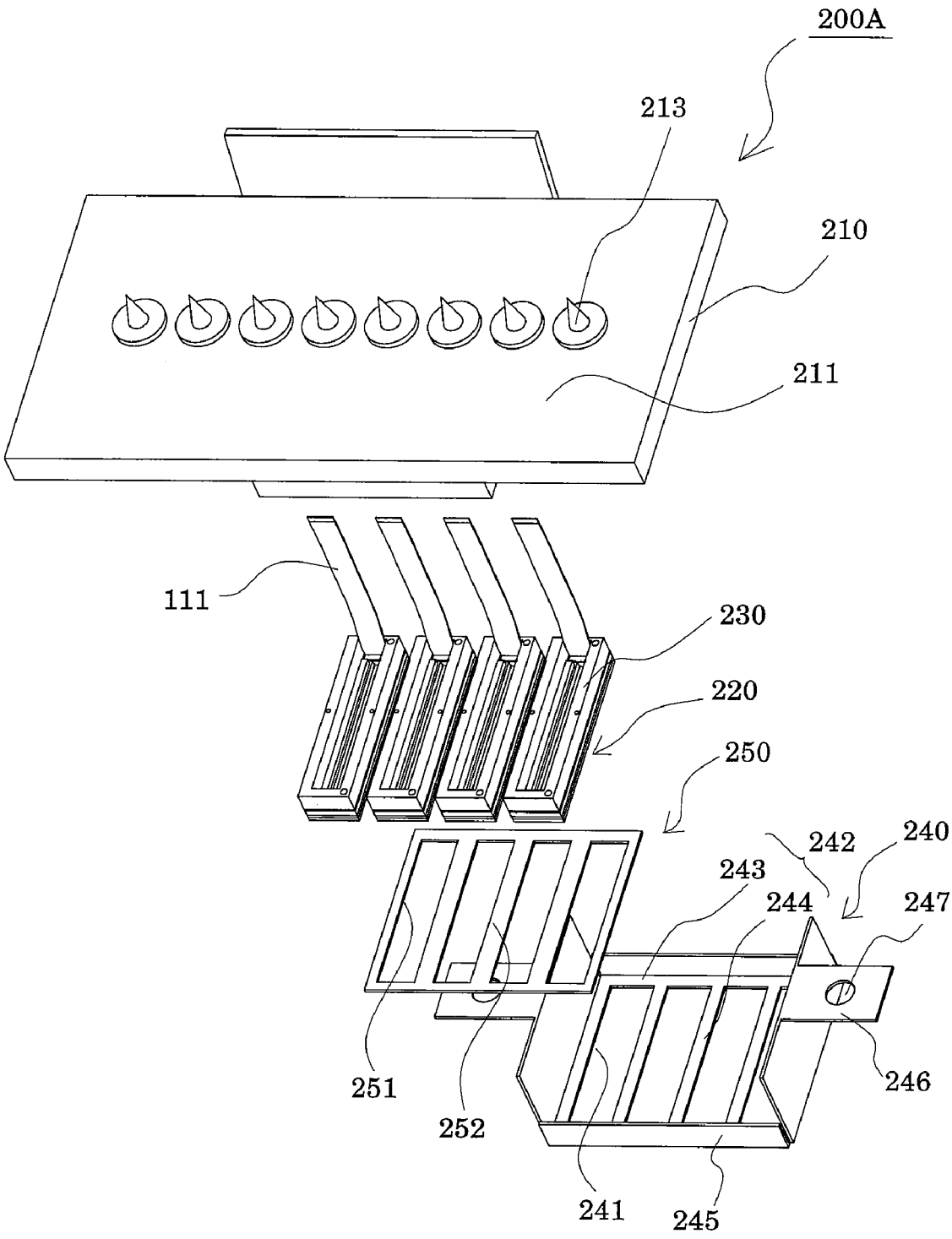
FIG. 9 is an exploded, perspective view of an inkjet recording head unit according to a second embodiment.

FIG. 9 is an exploded, perspective view of a head unit according to a second embodiment of the present invention. Incidentally, if members are the same as those of the first embodiment, the members will be denoted by the same reference numerals and symbols as those of the first embodiment, and accordingly duplication of the description will be omitted. In the case of a head unit 200A according to this embodiment, a plurality of inkjet recording heads 220 are held by a common fixing plate 250 joined to the ink-droplet ejecting surface by means of causing the common fixing plate 250 to align the plurality of inkjet recording heads 220 with one another, as shown in FIG. 9. This fixing plate 250 is formed of a flat plate, and includes exposure opening portions 251 and junction portions 252. Nozzle orifices 21 and dummy nozzles 22 are exposed through the exposure opening portions 251. The junction portion 252 defines the exposure opening portions 251, and is joined to the ink-droplet ejecting surface of each of the inkjet recording heads 220.

Positions of the plurality of such inkjet recording heads 220 can be aligned with the fixing plate 250 by use of an alignment jig 400, in common with the first embodiment. In other words, the fixing plate 250 is seen through the alignment jig 400. Thus, the inkjet recording heads 220 are fixed to the fixing plate 250 in a way that the positions of the alignment marks 401 match the position of the dummy nozzles 22 one-by-one on a surface of the fixing plate 250, which surface is at the other side of the fixing plate facing the alignment jig 400. In this manner, the positions of the plurality of such inkjet recording heads 220 can be aligned with the fixing plate 250.

At this time, areas in the nozzle plate 20, which areas correspond to the dummy nozzles 22, are provided respectively with non-water repellent portions 24. This improves the visibility of the dummy nozzles 22, and accordingly makes it possible to align the position of the ink recording heads 220 with the position of the fixing plate 250 with high precision. Concurrently, this makes it possible to relatively align each pair of the plurality of nozzle rows 21A with high precision.

Furthermore, the cover head 240 is fixed to a surface of the fixing plate 250, which surface is at the other side of the fixing plate facing the inkjet recording heads 220. This cover head 240 and the fixing plate 250 can be aligned with high precision, for example, by use of the alignment jig 400, and thereby the cover head 240 and the fixing plate 250 can be fixed to each other, in common with the first embodiment. The plurality of inkjet recording heads 220 have been beforehand fixed to the fixing plate 250 through aligning the plurality of inkjet recording heads 220 and the fixing plate 250 with each other.

In the case of this embodiment, the cover head 240 is joined to the surface of the fixing plate 250, which surface is at the other side of the fixing plate facing the inkjet recording heads 250. It should be noted, however, that no specific limitation is imposed on the junction. For example, instead of the cover head 240 being joined to the fixing plate 250, the cover head 240 may be provided to the fixing plate 250 with a predetermined space therebetween. Otherwise, the cover head 240 may be provided to the fixing plate 250 in a way that the cover head 240 is made to abut to the fixing plate 250. No matter which method may be used, the plurality of inkjet recording heads 220 are aligned with, and are fixed to, the fixing plate 250. This makes it possible to relatively align the plurality of nozzle rows 21A with one another with high precision.

The Other Embodiment

Each of the embodiments of the present invention has been described above. However, the present invention is not limited to the above-described embodiments. For example, in the case of the first and the second embodiments, the plurality of inkjet recording heads 220 are aligned with, and are fixed to, the cover head 240 or the fixing plate 250 by use of the dummy nozzles 22 provided respectively with the non-water repellent portions 24. However, an alignment, and fixation, is not specifically limited to this. Even in a case of a head unit including a single inkjet recording head 220, if areas in the nozzle plate 20, which areas correspond respectively to the dummy nozzles 22 are provided with the respective non-water repellent portions 24, the nozzle orifices 21 can be aligned with, and be fixed to, the cover head 240 and the like.

Moreover, the flange portion 246 including the side wall portion 245 and the fixing holes 247 are not necessarily required, although the cover head 240 is provided with the flange portion 246 including the side wall portion 245 and the fixing holes 247 in the case of the first and the second embodiments. Without the flange portion 246 which includes the side wall portion 245 and the fixing holes 247, ink can be prevented from remaining on the ink-droplet ejecting surface. In addition, the plurality of inkjet recording heads can be easily joined to the cover head 240 while relative positions in which the nozzle rows 21A are put are being determined with high precision.

Each of the embodiments of the present invention has been described giving the example of use of the dummy nozzles 22 which bring about no problem even if the dummy nozzles 22 are arranged away from the nozzle orifices 21 with the predetermined distance lest ink remaining in the non-water repellent portions 24 should influence the nozzle orifices 21 through which ink droplets are ejected. However, use of the dummy nozzles 22 is not necessarily required. Instead of use of the dummy nozzles 22, a non-water repellent portion can be provided with the peripheral portion surrounding each of the nozzle orifices 21 through which ink droplets are ejected, and which communicate respectively with the pressure generating chambers 12. Accordingly, the non-water repellent portion can be used as a visible mark while the positions are being aligned. However, in a case where a non-water repellent portion is provided with the peripheral portion surrounding each of the nozzle orifices 21 through which ink droplets are ejected, if the non-water repellent portion is formed in a range as narrow as possible within a visible range, this makes it possible to prevent the non-water repellent portion from influencing its neighboring nozzle orifices 21.

Additionally, the first and the second embodiments have been described giving the example of the inkjet recording head 220 of the flexure vibration type. However, the present invention is not limited to the inkjet recording head 220 of the flexure vibration type. It is needless to say that the present invention can be applied to unit heads including inkjet recording heads of various structures, including the following: an inkjet recording head of the vertical vibration type which expands, and contracts, piezoelectric elements and electrode-forming materials which have been laid over one another, in the axis direction thereof, and an inkjet recording head which ejects ink droplets by use of bubbles produced by heat from heat-producing elements or the like.

The liquid jet head has been described giving the examples of the head unit and the inkjet recording device, both of which include the inkjet recording heads. However, it should be noted that the present invention is intended broadly for an entire range of liquid jet head units and liquid jet devices, both of which include liquid jet heads. For example, what can be listed as liquid jet heads includes: recording heads used for image recording devices, such as printers; color material jet heads used for manufacturing color filters for liquid crystal displays and the like; electrode material jet heads used for forming electrodes for organic EL displays, field emission displays (FEDs) and the like; and living organic material jet heads used for manufacturing bio-chips.

What is claimed is:

1. A liquid jet head unit comprising:

a liquid jet head including a nozzle plate provided with nozzle rows constituted of nozzle orifices, and which are arranged side by side;

nozzles provided respectively with water repellent films in peripheries of their nozzle orifices;

nozzles which respectively have non-water repellent portions provided with no water repellent films in peripheries of their nozzle orifices, and a distance between a nozzle which has a non-water repellent portion and a nozzle provided with a water repellent film is longer than a distance between each neighboring two of the nozzles provided respectively with water repellent films.

2. The liquid jet head unit according to claim 1, wherein brightness of the non-water repellent portions is 11 times or more as strong as brightness of the water repellent films.

3. A liquid jet device, comprising the liquid jet head unit according to claim 2.

4. The liquid jet head unit according to claim 1, wherein the water repellent films are made of a metal film.

5. A liquid jet device, comprising the liquid jet head unit according to claim 3.

6. A liquid jet device, comprising the liquid jet head unit according to claim 1.

* * * * *